United States Patent [19]

Lukyanchikov et al.

[11] 4,126,533

[45] Nov. 21, 1978

[54] APPARATUS FOR SELECTIVE ELECTROPLATING OF WORKPIECES

[76] Inventors: Viktor E. Lukyanchikov, Sakhalinskaya ulitsa, 4, kv. 142; Ilya V. Baidalinov, 2 ulitsa Mariinoi roschi, 14a, kv. 18; Mikhail Y. Selivanov, Khersonskaya ulitsa 19, kv. 83, all of Moscow, U.S.S.R.

[21] Appl. No.: 818,087

[22] Filed: Jul. 22, 1977

[30] Foreign Application Priority Data

Jul. 28, 1976 [SU] U.S.S.R. ..... 2387555

[51] Int. Cl.[2] ..... C25D 17/00; C25D 17/06

[52] U.S. Cl. ..... 204/224 R; 204/225; 204/297 R

[58] Field of Search ..... 204/224 R, 224 M, 129.6, 204/129.65, 297 R, 212

[56] References Cited

U.S. PATENT DOCUMENTS

| | | | |
|---|---|---|---|
| 2,828,256 | 3/1958 | Gempe | 204/224 R X |
| 3,745,105 | 7/1973 | Kosowsky et al. | 204/224 R |
| 3,752,755 | 8/1973 | Krafft | 204/297 R X |
| 3,763,027 | 10/1973 | Pearson | 204/224 R |
| 4,029,564 | 6/1977 | Higuchi et al. | 204/224 R |
| 4,030,999 | 6/1977 | Allen | 204/224 R X |

*Primary Examiner*—John H. Mack

*Assistant Examiner*—D. R. Valentine

*Attorney, Agent, or Firm*—Lackenbach, Lilling & Siegel

[57] ABSTRACT

The apparatus comprises a plating unit, the cavity of which communicates with a plating solution feed system, and pressing means mounted above the plating unit. The pressing means according to the invention is made in the form of a magazine with two or more pressure surfaces whereon sealing members, workpiece orientation members and workpiece retaining members are mounted. The magazine is operatively connected to a vertical movement actuator in a manner which provides for rotation of the magazine about its horizontal axis. A masking member is mounted on the surface of the plating unit to mask the workpiece surface areas not to be plated. The apparatus comprises an anode which is mounted in the internal space or cavity of the plating unit in the path of the plating solution flowing towards the workpiece, and a cathode connected to the workpiece.

The apparatus ensures a higher efficiency of the plating process, due to the fact that simultaneously with the plating of workpieces pressed between the plating unit surface and one of the pressure surfaces of the magazine it is possible to remove plated workpieces from and place the next lot of workpieces to be plated onto the other pressure surface.

7 Claims, 5 Drawing Figures

H
A
B
III

APPARATUS FOR SELECTIVE ELECTROPLATING OF WORKPIECES

BACKGROUND OF THE INVENTION a. Field of the Invention

The invention relates generally to electroplating equipment and, more particularly, to apparatus for spray electroplating of selected areas of a workpiece. The preferred field of application is in the production of solid-state devices and microcircuits where the invention may be used, in particular, for the application of gold or other noble metals onto contact pads of a semiconductor body or clipped strips to provide for stable low resistance in these areas, which is not affected by the environment.

b. Description of the Prior Art

In spray plating, a workpiece connected to the negative pole of a voltage source is continuously sprayed with a plating solution, the areas not to be plated from the action of this solution having been insulated in advance. Ions of metal in the plating solution, positively charged as a result of the contact of the plating solution with the anode, are deposited on the surface of the workpiece.

Attempts to enhance the efficiency of the above process by feeding the workpieces continuously into the plating zone are opposed by the necessity of insulating the workpieces locally from the electrolyte, which requires firm engagement between the workpieces and insulating gaskets throughout the plating process.

Conventional conveyor-type apparatus for selective electroplating, which make it possible to reduce the time wasted on repositioning an elongated workpiece when treating different areas of its surface, have not found extensive application in plating with noble metals because of the irreparable losses of plating solution inevitable during the advance of a freshly plated workpiece, and also because of the relatively high cost stemming from their complicated and metal-consuming construction.

There is known in the art an apparatus for selectively and simultaneously electroplating a plurality of areas of a workpiece, as disclosed in the British Pat. No. 1393138. This apparatus comprises a plating unit, the cavity of which communicates with a plating solution feed system and the top wall of which serves as a workpiece supporting member, and means for pressing a workpiece and the supporting member together, which is movably mounted above the plating unit and operatively connected with a vertical movement mechanism such as a fluid cylinder.

Mounted on the external surface of the top wall of the plating unit are means masking the workpiece surface areas not to be plated and means for orienting the workpiece. There is a sealing gasket on the bottom external surface of the pressing means. The apparatus comprises an anode mounted in the path of the plating solution flow, as it is fed towards the workpiece, and a plurality of nozzles in the plating unit, through which the plating solution is sprayed onto the workpiece. The workpiece functions as the cathode of the apparatus. The upper wall of the plating unit has ports for access of plating solution to the exposed areas of the underside of the workpiece to be plated.

Workpieces placed on the masking means of the plating unit are pressed against the masking member by the sealing gaskets of the pressing means when the pressing means is in the lowered position.

Thus, the pressing means of the above machine performs the sealing function only, and as the workpiece orientation means are mounted on the stationary top wall of the plating unit directly under the pressing means, it is impossible to change workpieces before plating is completed and the pressing means is retracted into the raised position.

SUMMARY OF THE INVENTION

The invention has for its object the provision of an apparatus for selective local electroplating of workpieces, which provides for combining in time the process of plating workpieces and the unloading and loading operations, thereby reducing the time wasted on auxiliary operations and enhancing the efficiency of the process.

Another object of the invention is to provide an apparatus for selective local electroplating of workpieces, which would ensure uniform pressing or holding down of workpieces in the process of plating.

A further object of the invention is to provide an apparatus for selective local electroplating of workpieces wherein the force with which the workpieces are pressed or held down may be adjusted in the course of the treatment.

The invention is realized in an apparatus for selective local electroplating of workpieces comprising a plating unit in the form of a closed receptacle with an internal space communicating with an electrolyte supply system, an anode mounted in spaced relationship from said workpieces and in the path of the electrolyte flow, a top wall of the plating unit incorporating ports for the passage of the electrolyte towards workpieces, which are in contact with a cathode, and a means for masking the workpiece surface areas not to be plated positioned on the top wall of the plating unit; pressing means with sealing gaskets movably positioned above the plating unit, operatively connected with a vertical movement actuator, and comprising workpiece orientation means. The pressing means, according to the invention, includes a magazine with at least two pressure surfaces, each pressure surface having sealing gaskets and carrying said workpiece orientation means and workpiece holding means. The operative connection of the magazine with the vertical movement actuator rotates the magazine about its horizontal axis disposed substantially between the pressure surfaces so that when one of said pressure surfaces presses a workpiece against the masking means of the plating unit, the other pressure surface is in a position which makes it possible to place thereon another lot of workpieces.

The pressing or holding down means of the disclosed stucture makes it possible to combine in time the preparatory and after-treatment operations with the process of plating per se. Workpieces are unloaded and loaded on one side of the magazine, while its other side with workpieces placed thereon is in the plating zone, so that the only time that is ineffectually used is the time spent raising, rotating about the horizontal axis and lowering the magazine, which amounts to 5 seconds at the most. Thus, the plating time in an apparatus with a magazine having two pressure surfaces may amount to 95–98% of the whole cycle time, which makes it possible to almost double the output of the process without affecting the quality of the plating, as compared with conventional apparatus having non-rotatably mounted pressing means with a single pressure surface.

It is advisible that the magazine should be made in the form of a crosspiece with journals at the ends, the common axis of the journals being the axis of rotation of the magazine, and that the vertical movement actuator should incorporate movable rods having the magazine journals rotatably mounted therein.

The ends of the movable rods not connected to the journals may be pivoted to eccentrics mounted on the driven shafts of reducers which are interconnected by a common driving shaft for synchronous operation, and disposed symmetrically on both sides of the plating unit, which ensures uniform pressing of workpieces in the process of plating. The connection between the journals and the movable rods should provide for longitudinal travel of the movable rods relative to the journals.

The magazine journals may be connected to the movable rods of the vertical movement actuator with pins, which are pivoted in the journals and have guides for longitudinal travel of the movable rods, and with resilient members forcing the movable rods to the pins to develop the pressing effort.

In order to enhance the manufacturing of the component parts of the apparatus, it is expedient that the pins should be pivoted to the magazine journals by stems rotatably mounted in openings provided centrally of the journals, and that the pin heads extending beyond the journals should have openings made therein, their axes being normal to the common axis of the journals, and that their walls serve as the guides for longitudinal travel of the movable rods, each movable rod having a seating portion positioned in the respective pin opening for longitudinal travel within the limits of the resilient member deformation.

In particular, the movable rod may have a shoulder disposed on one side of the seating portion thereof and a threaded end disposed on the other side of the seating portion and extend beyond the pin, the resilient member being a compression spring received about the projecting threaded end of the movable rod and being compressed against the pin with an adjusting nut screwed on the projecting threaded end of the rod. Such an arrangement makes it possible to adjust the force pressing workpieces in the process of treatment.

To ensure uniform pressure on workpieces, it is preferable for the apparatus to have stationary guides positioned symmetrically on to both sides of the plating unit. Movable solid blocks should be vertically mounted in the guides and have openings in which the magazine journals are slidingly received. The slide blocks may have retaining means for ensuring a fixed angular position of the magazines during their vertical movement.

BRIEF DESCRIPTION OF THE DRAWINGS

The invention will be further explained by the description of embodiments thereof, with reference to the accompanying drawings wherein.

Figure 1:
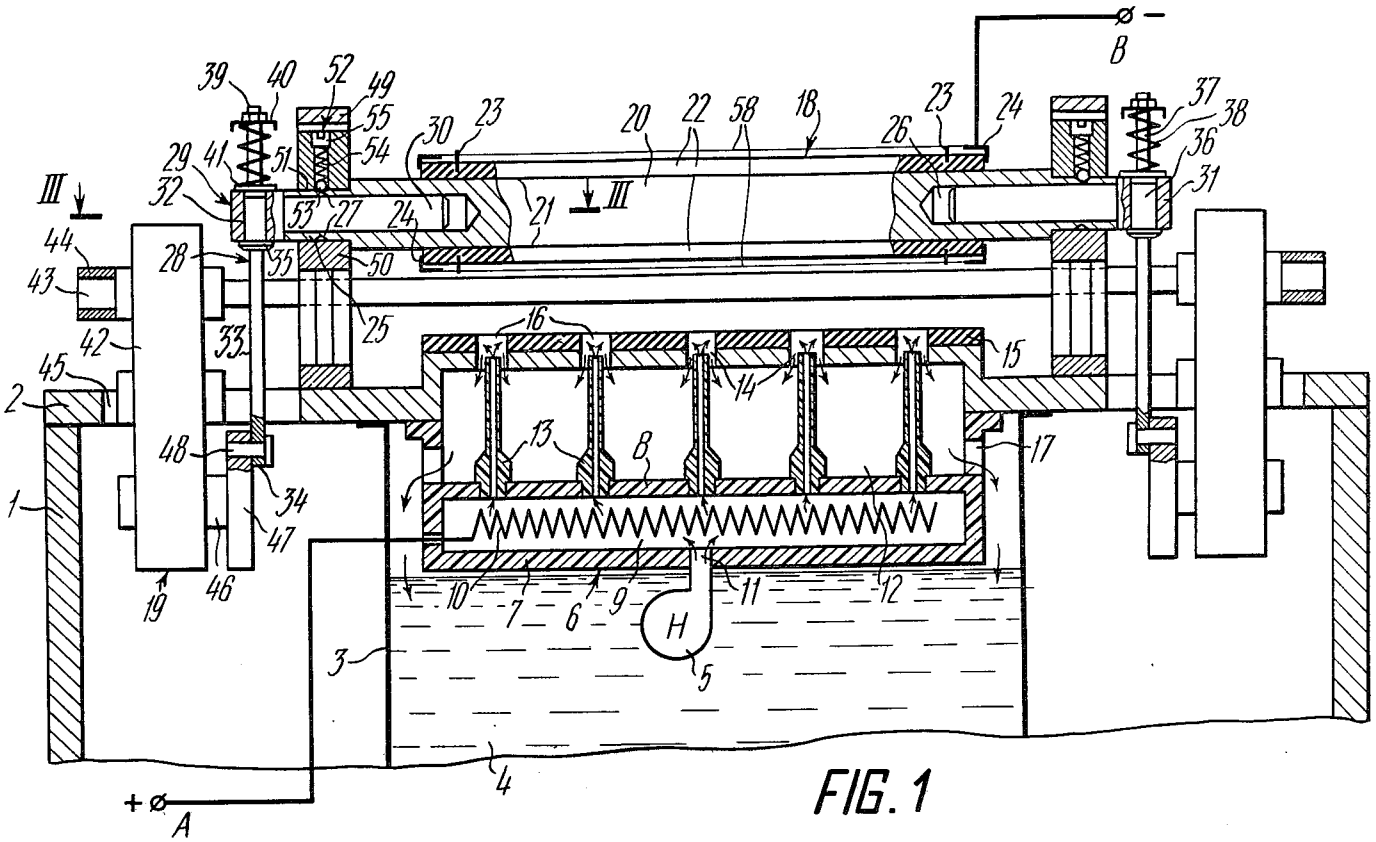
FIG. 1 is a front elevational view, partially in section and partially broken away, of an apparatus for selective electroplating of workpieces according to the invention used for gold-plating of clipped strips of integrated circuits.

The apparatus for selective electroplating of workpieces comprises a box framework 1 (FIG. 1) with a cover 2. Attached to the underside of the interior cover 2 within the space of the framework 1 is a tank 3 containing electrolyte or plating solution 4 which is a conventional solution of gold salts. The tank 3 in combination with a pump 5 immersed therein forms a plating solution feed system. A plating unit 6 is disposed inside the tank 3 above the plating solution 4. The plating unit 6 is made in the form of an enclosure incorporating a housing 7 and a portion of the cover 2, projecting upwards and merging with the housing 7. The housing 7 of the plating unit 6 is box-like in shape and is divided into two compartments by a horizontal partition 8. The lower compartment which defines a chamber 9 accommodates an anode 10 made in the form of a coiled wire and electrically connected to the positive terminal A of a power source (not shown). The bottom wall of the chamber 9 has an opening 11 which communicates with the delivery pipe of the pump 5.

The upper portion of the housing 7 forms together with the covers 2 of the framework 1 a chamber 12 which accommodates nozzles 13 vertically mounted in openings of the partition 8.

The top wall of the plating unit 6 formed by the cover 2 of the framework 1 is provided with passages 14 for the plating solution to pass through towards the workpieces, the passages encircling the ends of the nozzles 13 with an annular gap left therebetween. On the outside of the plating unit wall there is mounted a masking means 15 in the form of a resilient gasket with orifices 16 disposed opposite the passages 14 of the cover 2. The shape and the size of the orifices 16 correspond to the shape and the size of the workpiece surface areas which are to be plated.

The side walls of the housing 7 of the plating unit 6 have openings 17 through which the used plating solution flows back into the tank 3.

Movably mounted on the framework 1 above the plating unit 6 is a pressing means 18 (FIGS. 1,2) operatively connected to a vertical movement actuator 19. According to the invention, the pressing means 18 is made in the form of a magazine 20 (FIG. 1) having at least two pressure surfaces 21 carrying sealing gaskets 22, workpiece orientation members 23, which in the presently described embodiment are pins positioned in accordance with the arrangement of the reference openings in a workpiece, and retaining members 24 for fixing workpieces in the oriented position, e.g. latches or pawls. The retaining members 24 are connected to the negative terminal B of a power source (not shown in the drawings).

Abutments disposed along the contour of a workpiece, or any other conventional positioning means may be used as the workpiece orientation members 23. As the magazine 20 have two or more pressure surfaces 21 provided with positioning and retaining members, it is possible, while using one pressure surface 21 to press workpieces during plating, simultaneously to withdraw plated workpieces from the other pressure surface 21 and to place thereon other workpieces which are to be plated. Such a combination in time of the plating of workpieces with the preparatory and final operations provides for a higher operating efficiency of the process, as a whole.

In the herein described embodiment of the invention the magazine 20 is a rectangular crosspiece with cylindrical journals 25 at the ends, their common axis being the axis of rotation of the magazine 20.

Each journal 25 is formed with a central opening 26 of which the purpose will be described below. The outside cylindrical surfaces of the journals 25 in the diametral plane have slots 27 adapted to accommodate retaining elements.

The journals 25 of the magazine 20 are operatively connected to movable rods 28 of the vertical movement actuator 19 with pins 29, each pin having a stem 30 rotatably mounted in the opening 26 of the journal 25 and a head 31 extending beyond the journal 25. Each pin has an opening 32 of which the axis lies in its diametral plane and is normal to the axis of the opening 26. The walls of the opening 32 function as a guide for longitudinal travel of the movable rod 28. Each movable rod 28 has a bar 33 with a shackle 34, an abutment shoulder 35, a seating portion 36 received in the opening 32 and a threaded end 37 extending beyond the pin 29. Compression springs 38 are received about the threaded ends 37 of the movable rods 28, the springs 38 being resilient members, the deformation of which limits the longitudinal travel of the movable rods 28 within the openings 32. The compression springs 38 are compressed against the pins 29 with adjusting nuts 39 screwed onto the threaded ends of the movable rods 28. Thrust washers 40 are placed between the ends of the springs 38 and the adjusting nuts 39. Similar washers 41 are placed at the opposite side of the compression spring 38, between its other end and the pin 29.

The vertical movement actuator 19 (FIGS. 1, 2) comprises two reducers 42 having a common driving shaft 43 for synchronous operation, on which manual drive handles 44 are mounted. The reducers 42 are mounted in niches 45 (FIG. 1) of the cover 2 of the framework 1 and are secured thereto on the underside (not shown) symmetrically with respect to the plating unit 6, which ensures uniform transmission of the force to the pressing means 18 and, hence, uniform pressing of workpieces in the process of plating. Each reducer 42 (FIGS. 1, 2) has an individual driven shaft 46 whereon an eccentric 47 with a pin 48 is mounted. The shackles 34 of the movable rods 28 are pivoted to the pins 48 of the eccentrics 47.

Figure 3:
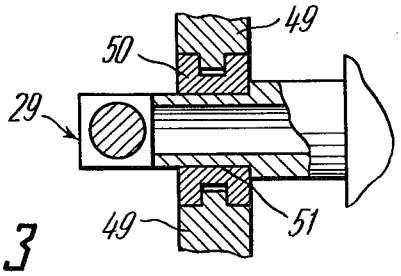
FIG. 3 is a cross sectional view taken along line III—III in FIG. 1.

Stationary guides 49 (FIG. 3) are secured to the cover 2 of the framework 1 (FIG. 1) symmetrically relative to the plating unit 6 and have two slide blocks 50 mounted therein for vertical reciprocation. The journals 25 of the rotary magazine 20 are rotatably mounted in the openings 51 of the slide blocks 50. Mounted in the slide blocks 50 are retaining members 52 (FIG. 1), each comprising a ball 53 pressed against the surface of the journal 25 by a spring 54 abutting against the end of a threaded plug 55. When the pressure surfaces 21 of the rotary magazine 20 are positioned horizontally, the balls 53 of the retaining members 52 engage the slots 27, as shown in FIG. 1.

For the purpose of the rational utilization of the floor space, it is expedient to mount several magazines 20 in one apparatus.

Figure 4:
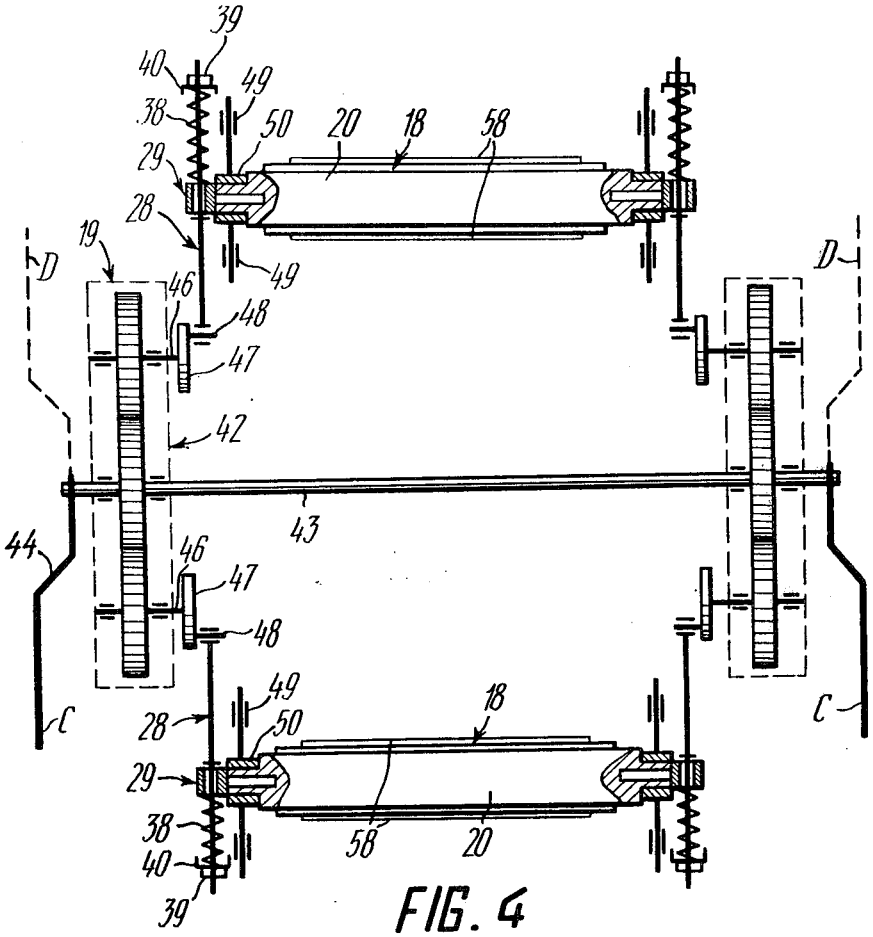
FIG. 4 is a schematic diagram of the drive system of an embodiment of the apparatus for selective electroplating of workpieces according to the invention.

FIG. 4 shows the preferred embodiment of the apparatus with two magazines 20. FIG. 1 shows a sectional view along the axis of rotation of one magazine of such apparatus.

In this embodiment the plating unit 6 has twice the number of nozzles 13 and masking means 15, and each reducer 42, as shown in the drive diagram in FIG. 4, accordingly has two driven shafts 46 with eccentrics 47.

Figure 5:
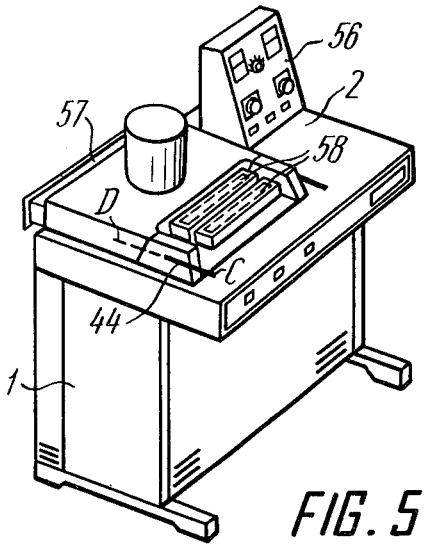
FIG. 5 is a perspective view of the apparatus shown in FIG. 4.

The apparatus is provided with a control unit 56 (FIG. 5) for controlling the process of plating, which is mounted on the cover 2 of the framework 1. On the same cover 2 an exhaust pipe 57 is mounted for drawing fumes and it communicates with the exhaust ventilation system (not shown).

In the preferred embodiment the apparatus for selective electroplating of workpieces operates, as follows.

Workpieces 58, e.g. clipped strips for integrated circuits, are placed on the surface of the sealing gasket 22 (FIG. 1) disposed on the upwardly facing pressure surface 21 of each magazine 20 (FIGS. 1, 4, 5) in the lowered position, the workpieces being oriented by means of openings in which the pins functioning as the orientation members 23 are received. The workpieces are fixed in the oriented position by the retaining members 24.

Figure 2:
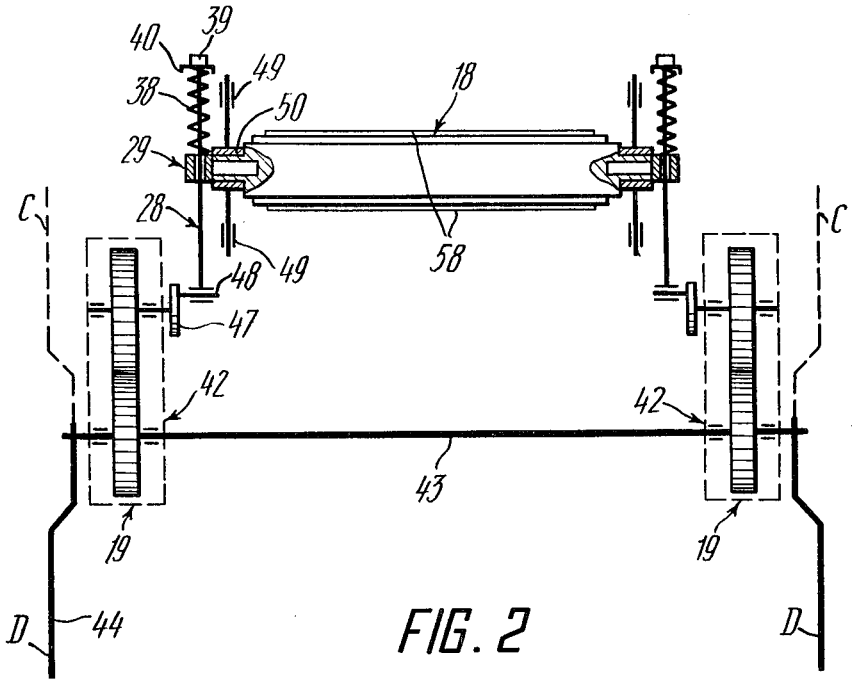
FIG. 2 is a schematic diagram of the drive system of the apparatus shown in FIG. 1.

Then the handles 44 are shifted from the position D into the position C, as shown in FIGS. 2 and 4.

The torque of the driving shaft 43 (FIGS. 1,4) is simultaneously transmitted to both driven shafts 46 of each reducer 42, which rotate the eccentrics 47 and thus upwardly move the pins 48 with the movable rods 28 mounted thereon. The movable rods 28 in their turn move the magazines 20 through the pins 29 into the raised position. Together with the magazines 20, the slide blocks 50 rise along the stationary guides 49, which prevents skewing of the magazines. During the rising of the magazines 20, their pressure surfaces 21 remain horizontal, the journals 25 being prevented from rotating in the slide blocks 50 by the retaining members 52 (FIG. 1). Meanwhile, the pins 29 freely rotate in the openings 26 of the magazine 20, which allows rotation of the movable rods, while they move along the axes of the openings 32 through the necessary distance.

When the magazines 20 are in the raised position, they are manually turned relative to the opening 51 in the slide blocks 50, thus overcoming the force of each spring 54 of the retaining member 52 and, consequently, urging the balls 53 against the surface of the journals 25. The efforts of the springs 54 can be preset by means of the threaded plugs 55. The magazines 20 are turned until the ball 53 of each respective member 52 gets into the next slot 27 of the journal 25, which corresponds to a revolution through 180°. As a result, the workpieces 58 placed for plating are put into the lowered position, opposite the masking means 15.

By shifting the actuating grips 44 from the position C into the position D (FIGS. 2, 4) the magazines 20 are moved into the lowered position. As a result, first the workpieces 58 (FIG. 1) and then the sealing gaskets 22 come into contact with the masking means 15 of the plating unit 6. The eccentricity of the pins 48 relative to the axes of the driven shafts 46 is selected so that after said resilient members touch the masking means 15, the movable rods 28 continue to move along the axes of the openings 32 of the pins 29 compressing the springs 38 and thereby developing a gradually increasing pressure force. The pressure force and the tightness of the joint determined thereby may be adjusted by the adjusting nut 39 and the thrust washer 40.

With the workpieces 58 pressed and reliably sealed, the power source is switched on, and current flows to the workpieces 58 through the negative terminal B of the power source and the orientation members 23 which are connected to the terminal B and function as a cathode.

Current flows to the anode 10 through the positive terminal A of the power source. Simultaneously, the drive of the pump 5 is actuated, and plating solution 4 is fed from the tank 3 into the lower chamber of the plating unit 6 wherefrom it flows about the anode 10 and through the openings of the nozzles 13 and passages 14 towards the surface areas to be plated of the workpieces 58, which are facing the nozzles 13 and passages 14 and, thus, are exposed for the action of the plating solution through the orifices 16 of the masking means 15. The ions of metal (gold) from the plating solution 4 are deposited on said surface areas of the negatively charged workpieces 58.

Used plating solution flows down through the annular spaces between the walls of the passages 14 and the nozzles 13 and through the openings 17 in the housing 7 of the plating unit 6 (as shown with arrows in FIG. 1) and returns into the tank 3.

Plating solution 4 is continuously circulated in the process of the deposition of metal.

Simultaneously with the process of plating, the already plated workpieces 58 are withdrawn from the upturned pressure surface 21 of the magazine 20 and replaced with other workpieces 58 which are to be plated. When the process of plating is finished, the apparatus is ready for the next cycle.

The proposed apparatus makes it possible to reduce time losses, by simultaneously carrying out the plating and auxiliary operations, and, thus, provides for a higher efficiency of the plating process without deteriorating the quality thereof.

It is to be understood that the names of the parts in description of the preferred embodiment are used with illustrative purposes only and should not limit the scope of the present invention.

We claim:

1. An apparatus for selective local electroplating of workpieces comprising:

a plating solution feed system;

a plating unit having an enclosed cavity communicating with said plating solution feed system, a top wall of the plating unit having passages for plating solution to pass through towards said workpieces;

a masking means mounted on said top wall of said plating unit to mask workpiece surface areas not to be plated;

pressing means in the form of a magazine with at least two pressure surfaces, each pressure surface having sealing gaskets;

workpiece orientation members mounted on each one of said magazine pressure surfaces;

means for fixing workpieces in the oriented position mounted on each one of said magazine pressure surfaces;

a vertical movement actuator operatively connected to said pressing means in a manner which provides for rotation of said magazine about a horizontal axis extending substantially between said pressure surfaces, so that when one of said pressure surfaces presses workpieces against said top wall of said plating unit, the other pressure surface is in a position which permits another lot of workpieces to be placed thereon or removed therefrom;

an anode mounted in the path of the flow of plating solution being fed towards said workpieces; and a cathode connected to said workpieces in the process of plating.

2. An apparatus for selective local electroplating of workpieces comprising:

a plating solution feed system;

a plating unit having an enclosed cavity communicating with said plating solution feed system, a top wall of the plating unit having passages for plating solution to pass through towards said workpieces;

a masking means mounted on said top wall of said plating unit to mask workpiece surface areas not be be plated;

pressing means in the form of a magazine with at least two pressure surfaces, each pressure surface having sealing gaskets, said magazine is a cross piece with journals at its ends, the common axis of these journals being an axis of rotation of said magazine;

workpiece orientation members mounted on each one of said magazine pressure surfaces;

means for fixing workpieces in the oriented position mounted on each one of said magazine pressure surfaces;

a vertical movement actuator operatively connected to said pressing means in a manner which provides for rotation of said magazine about said horizontal axis, so that when one of said pressure surfaces presses workpieces against said top wall of said plating unit, the other pressure surface is in a position which permits another lot of workpieces to be placed thereon or removed therefrom, said vertical movement actuator comprising movable rods in which said magazine journals are rotatably mounted;

an anode mounted in the path of the flow of plating solution being fed towards workpieces; and a cathode connected to said workpieces in the process of plating.

3. An apparatus according to claim 2, further comprising stationary guides symmetrically mounted on both sides of said plating unit; slide blocks mounted in said stationary guides for vertical reciprocation, said slide blocks being formed with openings in which said magazine journals are slidingly received and with a retaining member which ensures a fixed angular position of said magazines during vertical movement.

4. An apparatus according to claim 2, wherein said vertical movement actuator comprises a shaft; reducers mounted symmetrically on both sides of said plating unit and interconnected by said shaft, which is their common driving shaft, each of said reducers having an individual driven shaft; and an eccentric mounted on said individual driven shaft of each of said reducers and pivoted to the respective one of said movable rods at the end not connected to said magazine journals, the connection between said journals and movable rods providing for longitudinal motion of said rods relative to said magazine journals.

5. An apparatus according to claim 4, further comprising pins pivoted to said magazine journals, guides for longitudinal travel of said movable rods of said vertical movement actuator mounted on said pins, and resilient members connecting said movable rods to said pins to apply the pressing force to workpieces in the process of plating.

6. An apparatus according to claim 5, wherein each of said pins comprises a stem rotatably mounted in an opening formed centrally of the respective journal of said magazine and a head extending beyond the respective journal, each head of each of said pins being formed with an opening of which the axis is normal to the common axis of said journals and of which the wall serves as said guide for longitudinal travel of said movable rods, each one of said movable rods having a seating portion received in the respective one of said openings in said head so as to permit longitudinal travel of each movable rod within the limits of deformation of each one of said resilient members.

7. An apparatus according to claim 6, wherein each of said movable rods has an abutment shoulder formed on one side of said seating portion and a threaded end formed on the other side of said seating portion and extending beyond said respective pin, said vertical movement actuator comprising said resilient members in the form of compression springs received about the projecting threaded ends of said movable rods, and adjusting nuts screwed on the threaded ends and compressing said compression springs against said pins.

* * * * *